US005708232A

United States Patent [19]

Nedderman, Jr.

[11] Patent Number: 5,708,232

[45] Date of Patent: Jan. 13, 1998

[54] HIGHLY MANEUVERABLE UNDERWATER VEHICLE

[75] Inventor: William H. Nedderman, Jr., Middletown, R.I.

[73] Assignee: The United States of America as represented by the Secretary of the Navy, Washington, D.C.

[21] Appl. No.: 730,919

[22] Filed: Oct. 10, 1996

[51] Int. Cl.[6] ..... F42B 10/00

[52] U.S. Cl. ..... 114/23; 114/20.1; 244/3.1; 244/3.21; 244/3.23

[58] Field of Search ..... 114/20.1, 22, 23, 114/312, 330, 331, 341; 102/384; 244/3.1, 3.21, 3.23

[56] References Cited

U.S. PATENT DOCUMENTS

| | | | |
|---|---|---|---|
| 2,594,766 | 4/1952 | Goddard | 244/3.1 X |
| 2,654,334 | 10/1953 | Wheeler | 114/23 |
| 3,356,150 | 12/1967 | Ruszczycky et al. | 114/23 X |
| 3,461,829 | 8/1969 | Mosvold | 114/246 |
| 3,748,711 | 7/1973 | Smith | 254/323 |
| 4,076,187 | 2/1978 | Metz | 244/3.23 |
| 4,579,298 | 4/1986 | Thomson | 244/3.21 |
| 5,139,216 | 8/1992 | Larkin | 244/3.21 |

*Primary Examiner*—Michael J. Carone
*Assistant Examiner*—Matthew J. Lattig
*Attorney, Agent, or Firm*—Michael J. McGowan; Robert W. Gauthier; Prithvi C. Lall

[57] ABSTRACT

A system of articulation units is inserted between sections of a standard cylindrical underwater vehicle, such as a torpedo, to provide a highly maneuverable vehicle. Each articulation unit consists of two bulkheads connected by a spherical joint which allows rotation about the joint. The bulkheads are connected to adjacent torpedo sections by means of standard joint bands. A number of hydraulic actuators are spaced radially about the spherical joint between the bulkheads. By selectively activating the actuators, the joint bends the vehicle about its longitudinal axis. The pressure of the surrounding medium against the moving vehicle causes the vehicle to turn in the direction of the bend. Depending on the actuators activated, the vehicle can be made to bend, or turn, in any direction, making for a highly maneuverable vehicle. The articulation units have flexible cover membranes over the space between the bulkheads so as to present a smooth surface to the surrounding medium and hence not appreciably increase the drag on the torpedo.

10 Claims, 4 Drawing Sheets

HIGHLY MANEUVERABLE UNDERWATER VEHICLE

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates to an underwater vehicle having a high degree of maneuverability, and deals more particularly with an underwater vehicle having hydraulically actuated, articulated joints to control the movement of the vehicle through the water.

(2) Description of the Prior Art

Conventional underwater vehicles, such as torpedoes, are designed in a straight and elongated fashion so that they will run true. These types of vehicles are typically required to run at high speed in a generally straight path toward a target. Evasive action by the target requires the vehicle to have a degree of maneuverability in order to successfully engage the target. Steering fins are provided, typically at the aft end of the vehicle, to control the direction of the vehicle. However, the effectiveness of the fins is reduced by the straight and elongated shape of the vehicle. Steering vanes may also be provided at the forward end of the vehicle for increased maneuverability. However, such vanes greatly increase the vehicle's drag. The increased drag would require the vehicle to have a larger propulsion unit or the vehicle would move more slowly through the water. A larger propulsion unit may result in increased size, cost and radiated noise, and a slower vehicle may be incapable of attaining the target.

Another method which can be used to maneuver a vehicle is to bend the vehicle in the desired direction of travel. As the vehicle travels through the water in a straight path, a slight bend of the forward end in one direction would result in increased pressure against the opposite side of the vehicle. For example, bending the forward end of the vehicle to the right of the initial path results in increased pressure against the left side of the vehicle. The increased pressure forces the vehicle to turn to the right. To allow bending of the vehicle, the vehicle may be articulated, i.e., provided with a number of flexible joints. Underwater vehicles with flexible joints are well known in the art. The submersible sea train of Combs, Pat. No. 3,478,711, has a number of submersible cargo vessels coupled together and designed to be towed through the water by a forward propulsion unit. Sensors within the towed vessels activate ballast pumps which maintain proper relative buoyancy and submergence of the vessels and maintain the towed vessels in line with the propulsion unit. The forward propulsion unit provides the directional control for the sea train and there is no mechanism within the units for providing right and left control of the units. The system is not adapted for underwater vehicles having an aft propulsion unit, such as modern torpedoes. Mosvold, Pat. No. 3,461,829, describes a system for connecting and steering a pushed vessel, such as a barge being pushed by a tugboat. The system consists of a universal coupling connecting the barge and tugboat as well as securing cables from the tugboat to the barge. The cables are payed in and out to provide steering of the barge. The system is adapted for surface vessels and provides directional control only in a horizontal plane.

There is a need to provide an improved method of maneuvering a high speed, aft driven, underwater vehicle which does not appreciably increase drag or require a larger propulsion unit for the vehicle. However, given the large inventory and investment in present torpedoes, the maneuvering method must be able to be retrofit within the general geometry of present torpedoes and must further be able to utilize existing torpedo components.

SUMMARY OF THE INVENTION

Accordingly, it is a general purpose and object of the present invention to provide a highly maneuverable underwater vehicle which maintains the present, long cylindrical shape of present torpedoes.

Another object is to provide a highly maneuverable underwater vehicle having a maneuvering system which can control movement of the torpedo in a combination of horizontal and vertical planes when the torpedo has an aft propulsion drive.

A still further object is to provide a maneuvering system which can be retrofit to existing torpedoes and which utilizes current torpedo components.

These objects are accomplished with the present invention by providing articulation units located between the major sections, i.e., tail cone, fuel tank and payload sections, of an existing torpedo. Each articulation unit consists of two bulkheads connected by a spherical joint. The bulkheads are connected to adjacent torpedo sections and the spherical joint between the bulkheads allows the angular rotation of one torpedo section with respect to the other. Each articulation unit has a number of hydraulic actuators which control the angular rotation at the spherical joint. The articulation units have flexible cover membranes over the space between the bulkheads so as to present a smooth surface to the surrounding medium and hence not appreciably increase the drag on the torpedo. By selectively activating the hydraulic actuators, the torpedo can be made to bend and thus maneuver through the water.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein.

DESCRIPTION OF THE PREFERRED EMBODIMENT

Figure 1:
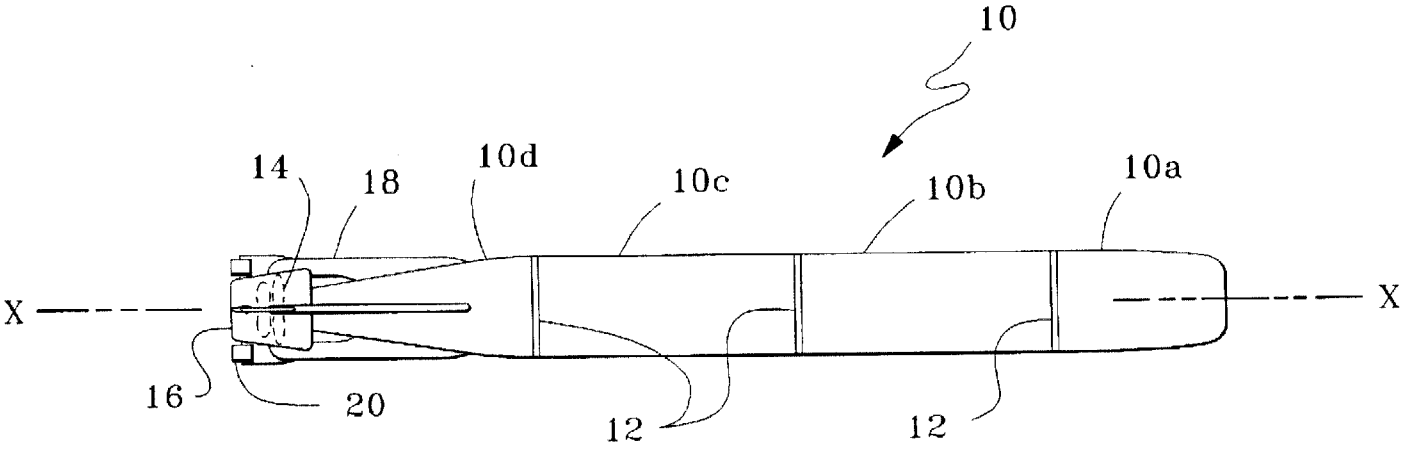
FIG. 1 PRIOR ART
FIG. 1 shows a side view of a standard torpedo.

Referring now to FIG. 1, there is shown a side view of a prior art torpedo 10. Torpedo 10 is of standard elongated cylindrical design having four sections: a control section 10*a;* a payload section 10*b;* a fuel tank section 10*c;* and a tail cone section 10*d*. The sections are connected by means of joint bands 12. Tail cone section 10*d* contains the propulsion unit (not shown) for the torpedo which turns the propellers 14 shown as dashed beneath shroud 16. Tail cone section 10*d* further includes damping vanes 18 and turning fins 20. Damping vanes 18 serve to prevent rolling of the torpedo about its longitudinal axis X—X. The direction of travel of torpedo 10 is determined by the orientation of turning fins 20 as controlled from control section 10*a* in a manner well known in the torpedo art.

Figure 2:
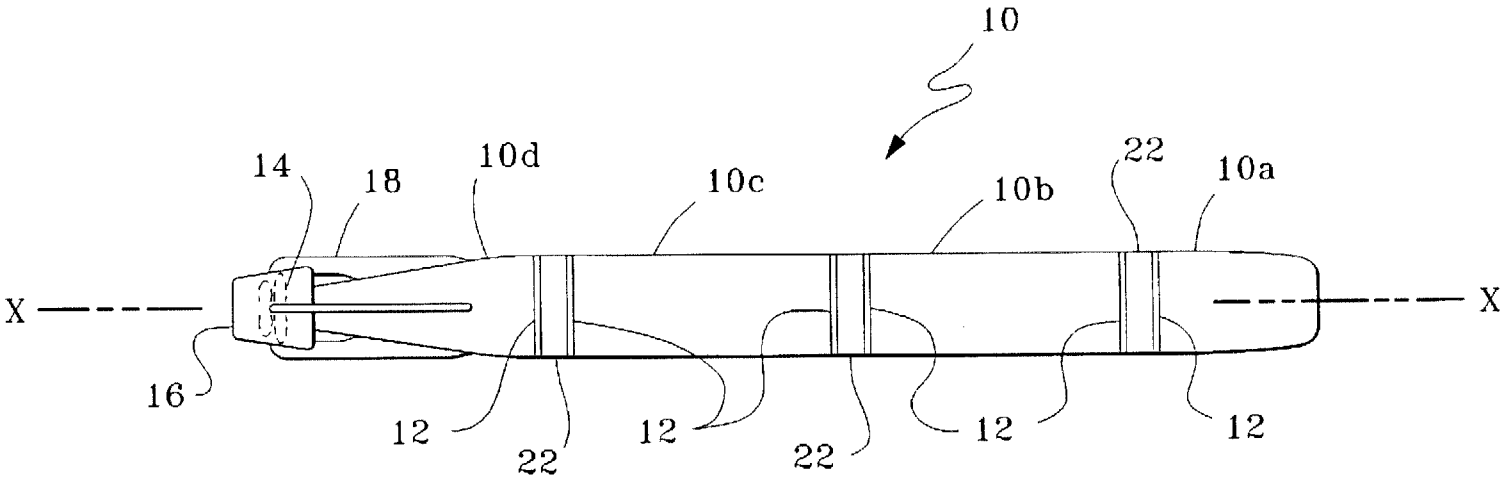
FIG. 2 shows the torpedo of FIG. 1 fitted with the articulation units of the present invention.
Figure 3:
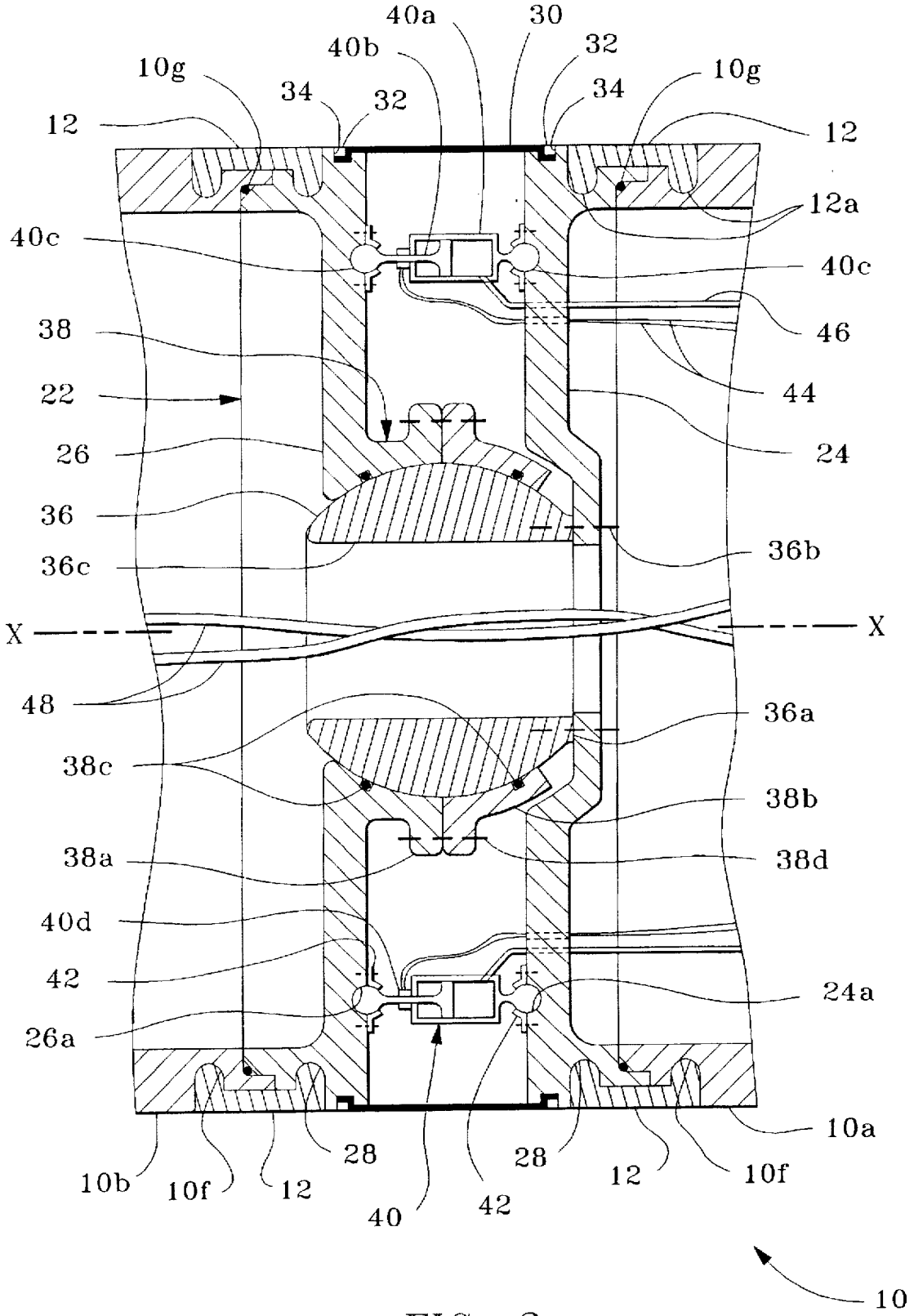
FIG. 3 shows a cross sectional view of an articulation unit taken along the axis X—X of the torpedo.

Referring now to FIG. 2, torpedo 10 is shown with articulation units 22 fitted between the sections 10*a–d*. The articulation units 22 are connected between the sections by means of an additional joint band 12, such that a joint between sections of the torpedo now includes a joint band 12 on either side of articulation unit 22. The articulation units 22 are used to control the direction of travel of the torpedo such that turning fins 20 indicated in FIG. 1 are no longer necessary and have not been shown in FIG. 2. It will be appreciated that turning fins 20 could remain to provide redundant directional control of torpedo 10. Referring now to FIG. 3, there is shown a cross section of an articulation unit 22 installed between two sections 10*a* and 10*b* of torpedo 10, taken along the axis X—X. Only a portion of torpedo sections 10*a* and 10*b* have been shown and it will be understood that articulation unit 22 may be installed between any two torpedo sections. Additionally, in the preferred embodiment shown, the features of articulation unit 22 are seen to be symmetrical about the axis X—X. For clarity, reference characters for some features have been indicated on only one side of axis X—X. Articulation unit 22 has a forward bulkhead 24 and an aft bulkhead 26 which are formed to mate with torpedo sections 10*a* and 10*b*, respectively, and with joint bands 12. Bulkheads 24 and 26 are circular in shape to conform with the shape of torpedo 10. Joint bands 12 are seen to be ring members which circumscribe torpedo 10. Each joint band 12 has two raised bosses 12*a* which mate with grooves 10*f* in torpedo sections 10*a* and 10*b* and with grooves 28 of bulkheads 24 and 26. A flexible cover membrane 30 circumscribes the space between bulkheads 24 and 26 to maintain the hydraulically smooth surface of torpedo 10. Membrane 30 is held in place by two retainer rings 32 which fit into respective grooves 34 in bulkheads 24 and 26. Standard o-ring seals 10*g* are provided to ensure the joints are watertight.

Pivot sphere 36 is securely attached to the center of forward bulkhead 24 facing aft bulkhead 26. In the preferred embodiment shown, a portion of sphere 36 is truncated to form base 36*a* which is attached to forward bulkhead 24 by means of screws, designated by dashed lines 36*b*. Aft bulkhead 26 is formed with pivot receptor 38 at its center. Receptor 38 defines a partial, concave, spherical surface matched to pivot sphere 36. Receptor 38 is fabricated in top and bottom portions, 38*a* and 38*b*, for assembly purposes. Pivot o-ring seals 38*c* ensure a tight seal of sphere 36 against receptor 38 while allowing sphere 36 to rotate angularly within receptor 38. To control the angular rotation of the sphere, hydraulic actuators 40 are radially spaced equally about sphere 36. In the preferred embodiment of FIG. 3, two of four hydraulic actuators 40 are shown. Clamps 42 are used to attach cylinder end 40*a* and piston end 40*b* to bulkhead 24 and 26, respectively. Together with ball ends 40*c* of hydraulic actuators 40 and spherical indents 24*a* and 26*a* of bulkheads 24 and 26, respectively, clamps 42 form a ball joint attachment of hydraulic actuators 40 to bulkheads 24 and 26. This attachment allows rotation of hydraulic actuators 40 while sphere 36 is rotated angularly. Hydraulic actuators 40 are fitted with well known linear position sensors 40*d* which provide a signal via leads 44 to the control system of torpedo 10 (not shown) corresponding to the amount of extension of piston end 40*b*. The control system acts to decrease or increase pressure in hydraulic lines 46 attached to cylinder end 40*a* of actuators 40 to move piston end 40*b* into or out of cylinder end 40*a* in a manner well known in the hydraulic actuator art. Bore 36*c* in sphere 36 allows for passage of hydraulic lines 46, electrical leads 44 and various other cabling, denoted as 48, between the various sections of torpedo 10.

In assembling articulation unit 22, pivot sphere 36 is first placed within bottom portion 38*b* of receptor 38. Top portion 38*a* is then placed over sphere 36 and firmly attached to bottom portion 38*b* by means of receptor screws, designated by dashed lines 38*d*. Forward bulkhead 24 is then attached to sphere 36 and actuators 40 are attached between bulkheads 24 and 26. The articulation unit can then be placed between two of the torpedo sections and joint bands 12 attached. Connections are then made to leads 44 and hydraulic lines 46 and leads 44, lines 46 and cabling 48 are passed through bore 36*d*. Finally membrane covers 30 are installed and the assembly is complete.

Figure 4:
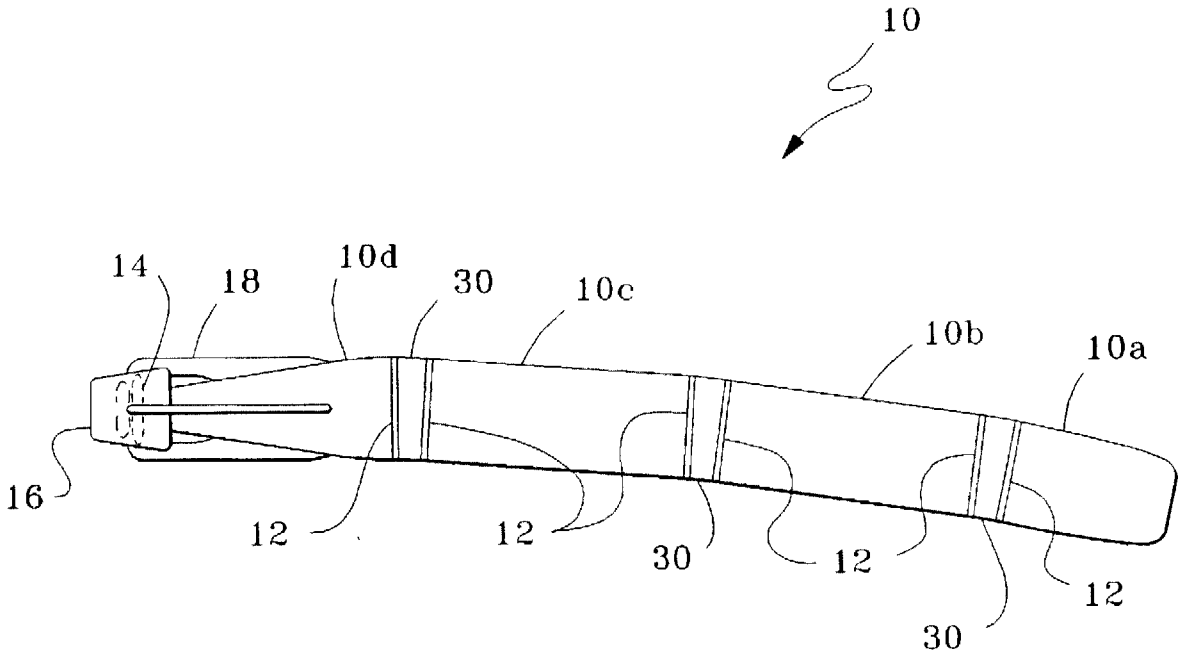
FIG. 4 shows a view of a torpedo with the actuators of the articulation unit activated for turning the torpedo.

Referring now to FIG. 4, torpedo 10 of FIG. 2 is shown in a turning position. To accomplish this maneuver, the control system of torpedo 10 would cause the extension of hydraulic actuators on the outward side of the curved trajectory shown and the retraction of hydraulic cylinders on the inward side of the curved trajectory. Note that membrane covers 30 have stretched or contracted to accommodate the movement of articulation units 22, thus closely maintaining the cylindrical shape of torpedo 10.

What has thus been described is a system of articulation units inserted between sections of a standard torpedo. The articulation units consist of two bulkheads connected by a spherical joint allowing angular rotation of the joint. Hydraulic actuators are radially spaced around the joint. Selective activation of the actuators by the torpedo control system provides for controlled bending of the torpedo about its longitudinal axis. As the torpedo is bent about the articulation units, the torpedo is turned in the direction of the bend, thus providing a highly maneuverable torpedo without the need for steering fins. The articulation units have flexible cover membranes over the space between the bulkheads so as to present a smooth surface to the surrounding medium and hence not appreciably increase the drag on the torpedo.

Obviously many modifications and variations of the present invention may become apparent in light of the above teachings. For example, the exact shapes and configurations of the particular components shown can be changed to suit manufacturing and assembly considerations. The number of actuators can be varied to suit the requirements. Additionally, the hydraulic actuators can be replaced with any known extension and retraction means, such as jack screws with small electric servo motors. Further, with minor modifications, the spherical joint could be replaced with any well known universal type joint.

In light of the above, it is therefore understood that within the scope of the appended claims, the invention may be practiced otherwise than as specifically described.

What is claimed is:

1. A highly maneuverable underwater vehicle having an elongated shape and comprising:

at least two sections;

at least one first bulkhead transverse to the longitudinal axis of the vehicle;

at least one second bulkhead transverse to the longitudinal axis of the vehicle and spaced a distance apart from the at least one first bulkhead along the longitudinal axis of the vehicle;

at least one sphere attached to the at least one first bulkhead and extending in the direction of the at least one second bulkhead; and at least one concave, partial spherical surface receptor member attached to the at least one second bulkhead and extending in the direction of the at least one first bulkhead for receiving the at least one sphere in a manner preventing movement of the at least one sphere away from the at least one receptor member and allowing rotation of the at least one sphere within the at least one receptor member, the at least one first bulkhead, at least one second bulkhead, at least one sphere and at least one receptor member forming at least one articulation unit connecting adjacent sections of the vehicle, the at least one articulation unit providing for controlled angular rotation of adjacent sections with respect to a longitudinal axis of the sections, the angular rotation causing the vehicle to turn in the direction of the rotation when the vehicle is propelled through the water by a pushing force, the rotation of the sphere corresponding to the angular rotation of the sections of the vehicle.

2. The vehicle of claim 1 wherein the receptor member comprises:

a first concave, partial hemispherical surface attached to the second bulkhead; and a second concave, partial hemispherical surface, the pivot joint being assembled by placing the sphere within the first partial hemispherical surface, placing the second partial hemispherical surface over the sphere and connecting the first and second partial hemispherical surfaces.

3. The vehicle of claim 2 further comprising a flexible cover membrane extending between the first and second bulkheads along the longitudinal axis of the vehicle and conforming to the shape of the vehicle.

4. The vehicle of claim 1 wherein the at least one articulation unit further comprises a plurality of actuators disposed between the sections of the vehicle and acting in concert against the sections of the vehicle to control the angular rotation of the sections.

5. The vehicle of claim 4 wherein the plurality of actuators are hydraulic actuators.

6. The vehicle of claim 4 wherein the actuators are jack screw actuators.

7. The vehicle of claim 2 wherein the at least one articulation unit further comprises a plurality of hydraulic actuators disposed between the sections of the vehicle and acting in concert against the sections of the vehicle to control the angular rotation of the sections.

8. The vehicle of claim 7 wherein the actuators further comprise:

a cylinder end rotatably attached to the first bulkhead and containing an amount of hydraulic fluid under pressure; and a piston end rotatably attached to the second bulkhead and engaged in the cylinder end such that the piston moves within the cylinder in response to the pressure of the hydraulic fluid.

9. The vehicle of claim 8 wherein the concerted action of the actuators is controlled by a vehicle control system comprising:

a linear position sensor for sensing the position of the piston end within the cylinder end and providing a position signal corresponding to the position; and a hydraulic controller for changing the pressure of the hydraulic fluid within the cylinder end in response to a command for turning the vehicle in a desired direction, the amount of pressure change being dependent on the position signal received from the position sensor and the desired turning direction.

10. The vehicle of claim 9 further comprising a flexible cover membrane extending between the first and second bulkheads along the longitudinal axis of the vehicle and conforming to the shape of the vehicle.

* * * * *